US011583863B2

(12) United States Patent
Subbannavar et al.

(10) Patent No.: US 11,583,863 B2
(45) Date of Patent: Feb. 21, 2023

(54) PULSE POLISHING MACHINE AND A METHOD THEREOF

(71) Applicant: BUHLER (INDIA) PVT. LTD., Karnataka (IN)

(72) Inventors: Chaithanya Subbannavar, Karnataka (IN); Akendra Verma, Karnataka (IN); Krishan Kumar Tyagi, Karnataka (IN)

(73) Assignee: Buhler (India) PVT. LTD., Karnataka (IN)

( * ) Notice: Subject to any disclaimer, the term of this patent is extended or adjusted under 35 U.S.C. 154(b) by 1047 days.

(21) Appl. No.: 16/323,913

(22) PCT Filed: Aug. 11, 2017

(86) PCT No.: PCT/IN2017/050339
§ 371 (c)(1),
(2) Date: Feb. 7, 2019

(87) PCT Pub. No.: WO2018/029709
PCT Pub. Date: Feb. 15, 2018

(65) Prior Publication Data

US 2019/0168225 A1 Jun. 6, 2019

(30) Foreign Application Priority Data

Aug. 11, 2016 (IN) ..... 201641027510

(51) Int. Cl.
*B02B 3/04* (2006.01)
*B02B 7/02* (2006.01)
*B02B 3/02* (2006.01)

(52) U.S. Cl.
CPC ..... *B02B 3/04* (2013.01); *B02B 7/02* (2013.01); *B02B 3/02* (2013.01)

(58) Field of Classification Search
CPC ..... B02B 3/04; B02B 3/02; B02B 7/02
(Continued)

(56) References Cited

U.S. PATENT DOCUMENTS 3,260,468 A * 7/1966 Beard ..... B02C 13/02 241/43
3,485,280 A * 12/1969 Satake ..... B02B 3/04 99/614
5,271,570 A * 12/1993 Satake ..... B02C 9/04 241/8

FOREIGN PATENT DOCUMENTS

CN 201543436 * 8/2010
CN 201543436 U 8/2010
(Continued)

OTHER PUBLICATIONS

International Search Report in PCT/IN2017/050339, dated Feb. 9, 2018.

*Primary Examiner* — Jessica Cahill
*Assistant Examiner* — Smith Oberto Bapthelus
(74) *Attorney, Agent, or Firm* — Kilpatrick Townsend & Stockton LLP

(57) ABSTRACT

The present invention relates to a pulse polishing machine. In one embodiment, the machine includes a base frame having protruded vertical supports at longitudinal ends and a rotor assembly placed between the vertical supports through a drive shaft. Rotor assembly having plurality of rotary disks mounted at the ends and centre of the drive shaft and a circular cam assembly fixed on the rotary disks. Further, a sheet basket assembly having plurality of circular shaped segments surrounds the rotor assembly defines the polishing chamber. An inlet means and an outlet means are positioned on the sheet basket assembly at diagonally opposite ends. Segments of split covers are used to cover the polishing chamber from either ends. And the ends of the polishing chamber are covered by a pair of split covers. An electric motor is connected to one end of the drive shaft to impart rotary motion to the rotor assembly for polishing pulses.

11 Claims, 5 Drawing Sheets

(58) Field of Classification Search
USPC ..... 99/519
See application file for complete search history.

(56) References Cited

FOREIGN PATENT DOCUMENTS

| | | | |
|---|---|---|---|
| CN | 204310364 | U | 5/2015 |
| DE | 3839778 | A1 | 5/1990 |
| JP | S6219249 | A | 1/1987 |

* cited by examiner

212

214

PULSE POLISHING MACHINE AND A METHOD THEREOF

CROSS REFERENCE TO RELATED APPLICATIONS

This application is a U.S. National Phase Application of PCT/IN2017/050339, International Filing Date Aug. 11, 2017, which claims the benefit of IN 201641027510, filed Aug. 11, 2016, the disclosures of which are incorporated herein by reference.

FIELD OF INVENTION

The present invention relates to a pulse polishing machine, more particularly relates to a frictional type pulse polishing machine.

BACKGROUND OF THE INVENTION

Pulses/grains occupy important place in the world food and nutrition economy. Pulses are an important constituent in the diet, and are primary sources of protein. They also provide substantial quantity of minerals and vitamins to the diet. There are different varieties of pulses namely Bengal gram, Green gram, Red lentils, Black gram, Pigeon pea etc. The grains are converted into dal through the process of milling, wherein dal is split into smaller sizes rendering it convenient for cooking.

The cotyledon of dry seeds excluding seed coat is called dal. All dal are consumed with acceptable appearance, texture, palatability, digestibility, and overall nutritional quality. The polishing is one of the important value addition steps in dal processing. Polishing is done to remove dust and to improve the appearance of the dal, which helps in fetching premium price to the processor. Whole pulses such as Bengal gram, Green gram, Red lentil, Black gram, Pigeon pea etc. are polished for value adding. Some consumers prefer unpolished dal, whereas others need dal with attractive colour (polished dal). Accordingly, dal is polished in different ways such as leather (polish), nylon (polish), oil-water (polish), cotton (polish) and so on as polishing media.

Polishing is a process of removal of dust from the surface. The cylindrical roller mounted with hard rubber, leather/roller mounted with brush are used for the purpose. Another type of machinery for this purpose is a set of screw conveyors for repeated rubbings. The shaft here is covered with either a leather or nylon rope or with velvet cloth, where the repeated rubbing adds to the luster of the dal, which makes it more attractive. These polishers are commonly known as leather polisher or nylon polisher/velvet polisher depending upon the polishing material and are available in a set of 2, 3, 4 or 5 screw conveyors.

Although, available machines are effective in polishing pulses, the high friction between dal and polishing material results in wear out of polishing material rapidly. Since, polishing material like leather, hard rubber or nylon comes in direct contact with the dal, and also use of white powder on the surface of dal to increase the shine and smoothness the process is un-hygienic. Other drawback includes need of high power motor for the operation of machine and an increase of about 30° C. temperature of product as it moves from input to output during operation. Hence it is necessary to provide a machine which eliminates all the drawbacks.

SUMMARY OF THE INVENTION

The present invention relates to a pulse polishing machine, more particularly relates to a frictional type pulse polishing machine in which pulses are polished through a polishing chamber between a rotor assembly and a sheet basket assembly.

According to one aspect of the invention, a pulse polishing machine includes a base frame having vertical support at longitudinal ends, and a rotor assembly placed between the vertical supports through a drive shaft. A plurality of rotary disks mounted at the ends and centre of the drive shaft and a circular cam assembly fixed on the rotary disks. The cam assembly further consists of a straight cam set and a helix cam set, and are connected. Each straight cam set and the helix cam set are made of plurality of straight cams and plurality of helical cams respectively. The straight cam and the helix cam has protruded circular profile in straight line and curved line. Further, a sheet basket assembly having plurality of circular shaped segments surrounds the rotor assembly defines the polishing chamber. An inlet means and an outlet means positioned diagonally at the opposite ends on the sheet basket assembly. The segments of split covers are used to cover the polishing chamber from either ends. An electric motor is connected to one end of the drive shaft for imparting rotary motion to the rotor assembly.

According to another aspect of the invention, a method of polishing pulses includes, mixing of pulses with water in a mixing chamber or screw conveyor. Further water mixed pulses are fed into the polishing chamber through an inlet means which is formed between the outer surface of the cam assembly and the sheet basket assembly. The polishing of pulses ensues by means of pulse to pulse friction inside the polishing chamber and the polished pulses are removed from the polishing chamber through an outlet means.

Yet another aspect of the invention is to provide a friction type pulse polishing machine which is highly hygienic. The other aspect of the invention is to decrease the power requirement for the operation thereby controlling the increase in temperature of pulses at output. Yet another aspect include imparting uniform polishing on flat and curved surfaces, thereby to eliminate rounding of pulse edges and to decrease the reduction in number of broken pulses percentage thereby to overcome the aforesaid drawbacks of the prior art.

DETAILED DESCRIPTION OF DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

In the claims, all transitional phrases such as "comprising," "including," "carrying," "having," "containing," "involving," and the like are to be understood to be open-ended, i.e., to mean including but not limited to. Only the transitional phrases "consisting of" and "consisting essentially of," respectively, shall be closed or semi-closed transitional phrases.

To facilitate the understanding of this invention, a number of terms may be defined below. Terms defined herein have meanings as commonly understood by a person of ordinary skill in the areas relevant to the present invention. Terms such as "a", "an", and "the" are not intended to refer to only a singular entity, but include the general class of which a specific example may be used for illustration. The terminology herein is used to describe specific embodiments of the invention, but their usage does not delimit the disclosed system or method, except as may be outlined in the claims.

Figure 1:
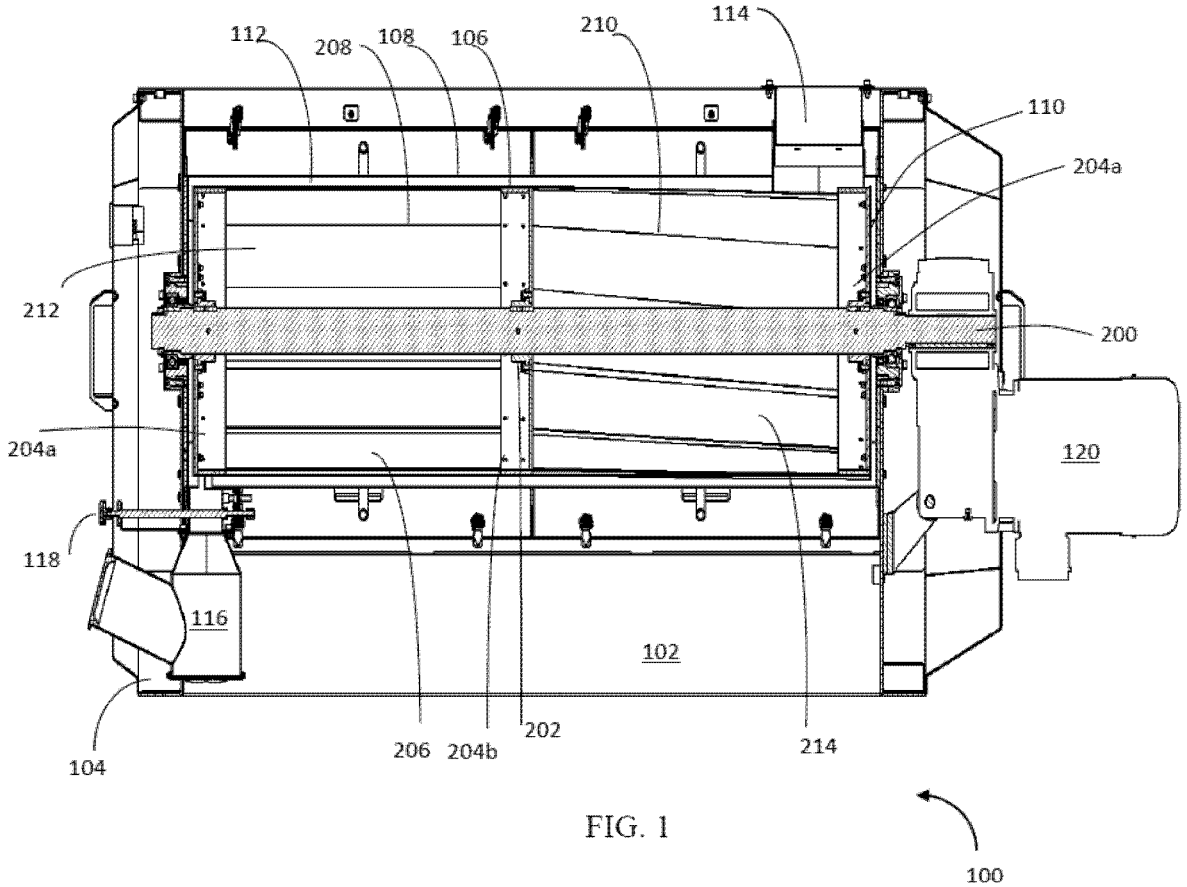
FIG. 1 illustrates vertical cross sectional view of pulse polishing machine, according to an embodiment of the invention.

FIG. 1 shows vertical cross sectional view of a pulse polishing machine 100 according to an embodiment of the invention. A pulse polishing machine 100 has a base frame 102 having vertical supports 104 at the longitudinal ends of the base frame. A rotor assembly 106 consisting of a long drive shaft 200 with keyway cut-outs, is positioned between the vertical supports 104. The drive shaft 200 is connected with rotary disks 204 namely side rotary disks 204*a* and middle rotary disks 204*b* at preferably equidistance through connector bush 202, wherein side rotary disks 204*a* has single threaded holes and middle rotary disk 204*b* has double threaded holes on the outer peripheral surface. Further, rotor assembly 106 consists of a cam assembly 206 on its rotary disks 204. A cam assembly 206 consists of a straight cam set 208 and a helix cam set 210 which connects and encircles rotary disks 204 in a circular profile in the direction of rotation. Helix cam set 210 consists of plurality of helix cams 214 fitted towards product inlet, and straight cam set 208 consists of plurality of straight cams 212 fitted towards product outlet. In an embodiment each straight cam set 208 and helix cam set 210 has 12 each straight cams 212 and helix cams 214 respectively. Further, a sheet basket assembly 108 is constructed by connecting four circular shaped segments 108*a* and it is fitted around the rotor assembly 106 which defines polishing chamber 112 between the outer surface of the cam assembly 206 and the sheet basket assembly 108. A pair of split covers 110 covers the rotor assembly 106 from its sides. An electric motor 120 is coupled to drive shaft 200 for imparting rotary motion to the rotor assembly 106. Pulses enter the polishing chamber 112 through inlet means 114 viz. hopper at one end of the sheet basket assembly 108 and leaves through outlet means 116 at other end. Both inlet 114 and outlet means 116 are placed diagonally opposite according to sheet basket assembly 108. Outlet means 116 can be an outlet hopper to guide the polished pulses out. The outlet hopper can have inspection port for checking and inspecting pulses from machine outside. The outlet flow is controlled by a discharge control assembly 118 positioned between outlet of polishing chamber and outlet means. The discharge control assembly 118 apart from controlling the output flow helps to build the pressure inside the chamber 112.

Figure 2:
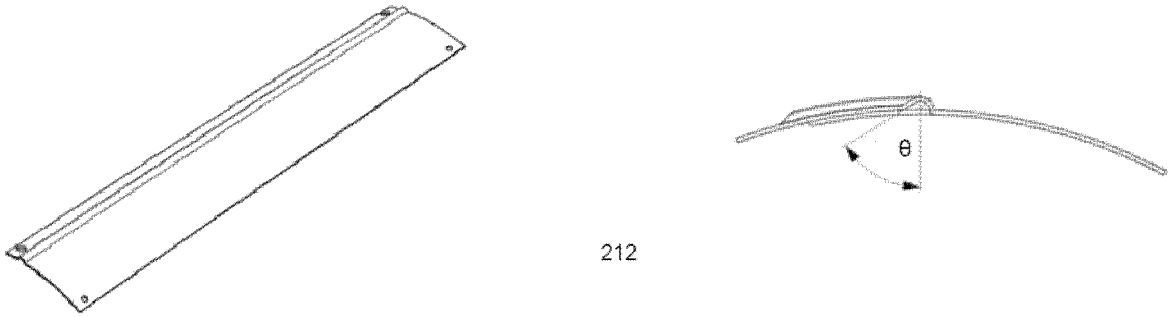
FIG. 2 illustrates isometric view of helix cam, according to an embodiment of the invention.
Figure 3:
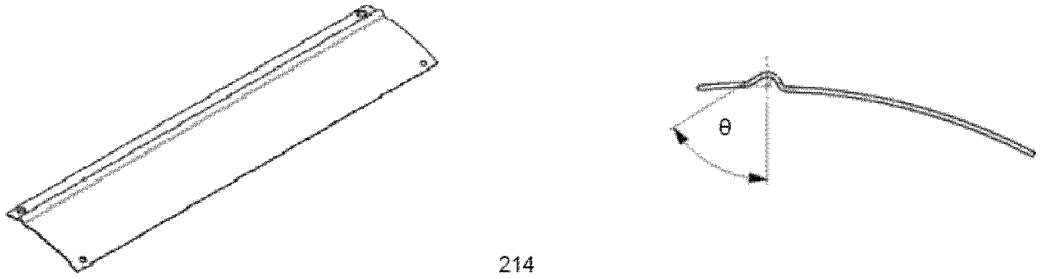
FIG. 3 illustrates isometric view of straight cam, according to an embodiment of the invention.

FIG. 2 and FIG. 3 shows isometric view of straight cam 212 and helix cam 214 respectively. According to the present embodiment of the invention, both straight cam 212 and helix cam 214 have unique shapes on their outer surface. Both, straight cam 212 and helix cam 214 as protruded circular profile preferably of 3-15 mm radius at an angle 'θ' (may be an angle range from 40° to 70°, preferable angle can be 58°), where the one as in a straight line while the other as in a curved line along the outer periphery.

Figure 4:
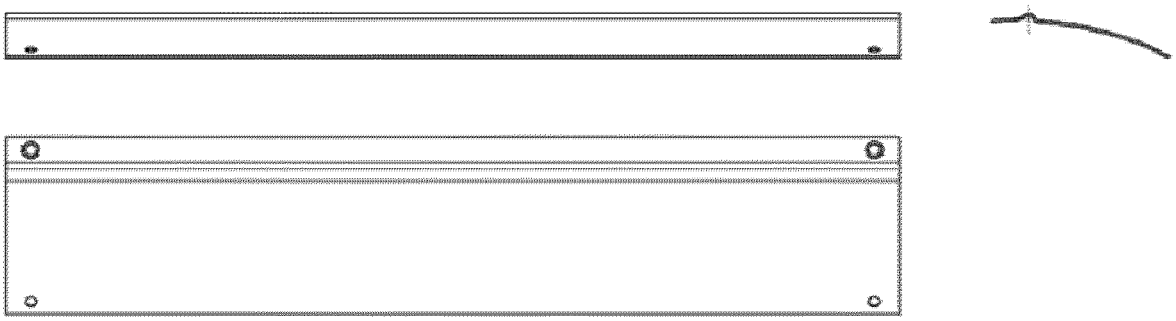
FIG. 4 illustrates front view, top view and side view of straight cam, according to an embodiment of the invention.
Figure 5:
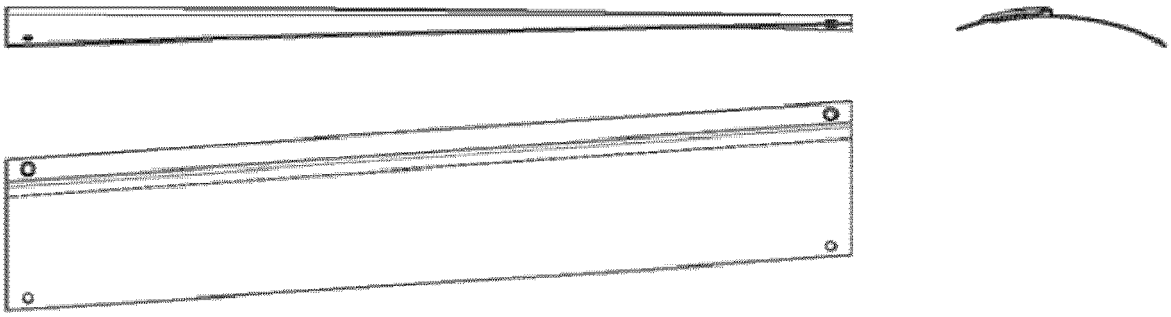
FIG. 5 illustrates front view, top view and side view of helix cam, according to an embodiment of the invention.

FIG. 4 and FIG. 5 shows front view, top view and side views of the straight cam 212, and helix cam 214 respectively. The helix cams 212 are fitted towards product inlet to chamber and straight cams 214 are fitted towards outlet of chamber. Said helix cam 214 pushes the material forward and also helps for rotary motion of individual pulse.

Figure 6:
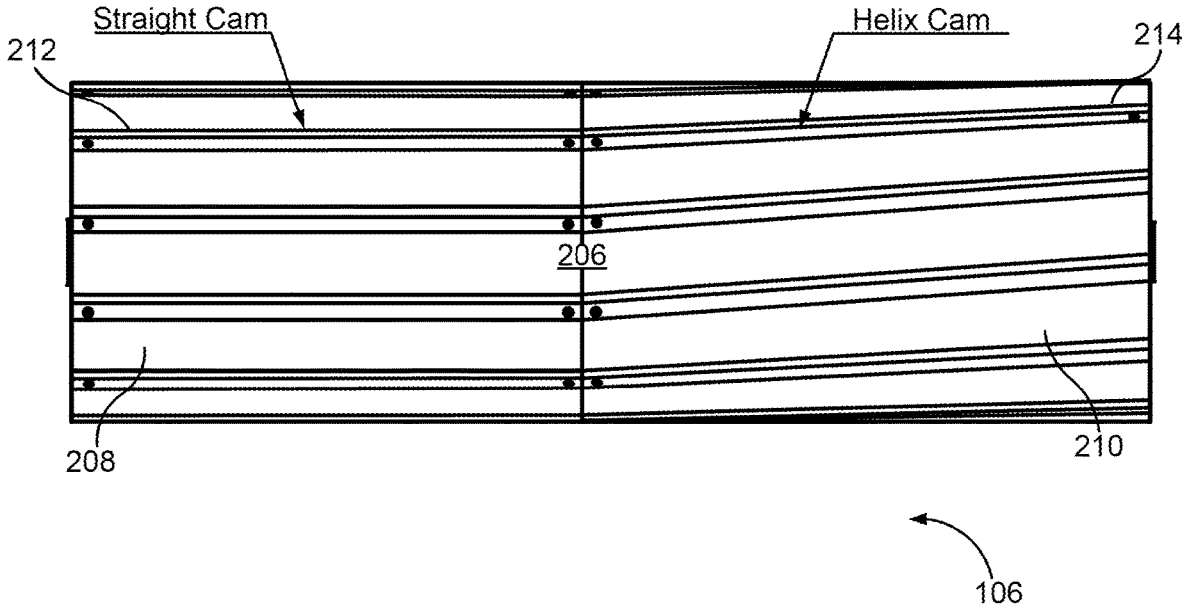
FIG. 6 illustrates front view of rotor assembly, according to an embodiment of the invention.

FIG. 6 illustrates front view of rotor assembly 206 of pulse polishing machine 100, according to an embodiment of the present invention. Where, a cam assembly 206 consists of a helix cam set 210 and a straight cam set 208 connected together and encircles rotary disks 204 so that the circular profile is placed in the direction of rotation.

Figure 7:
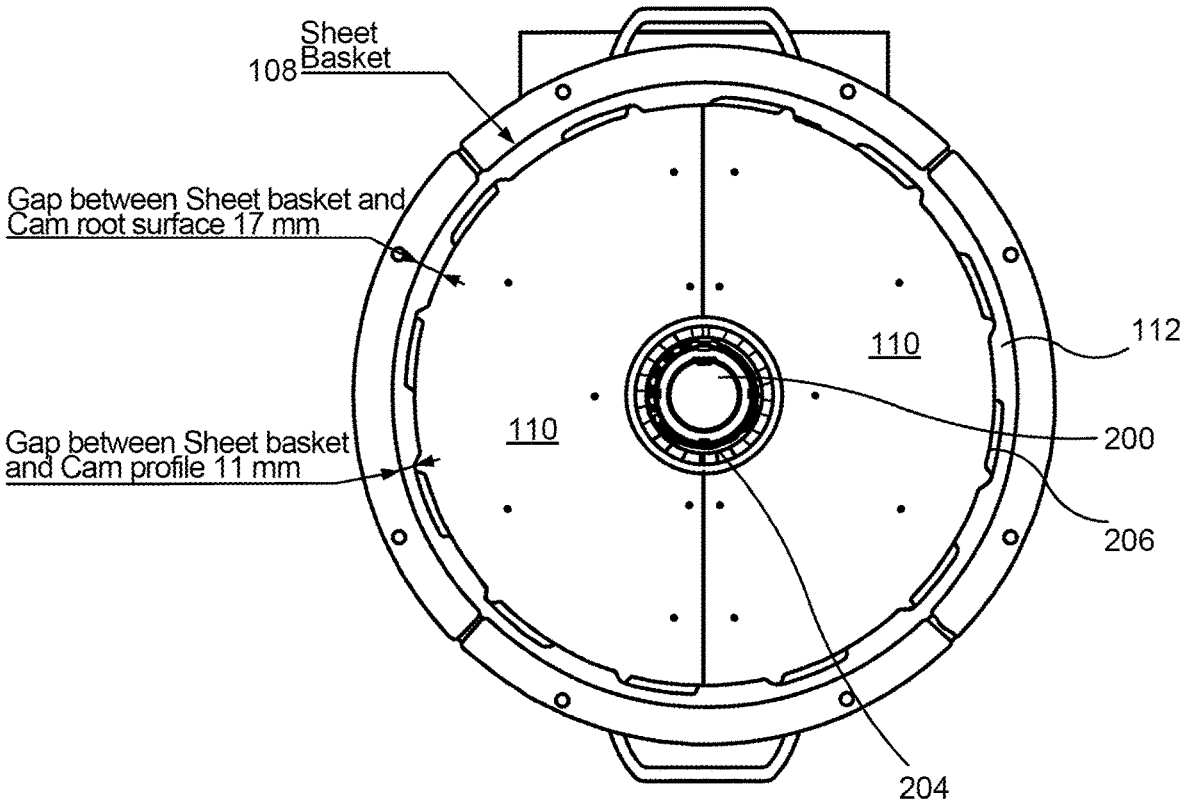
FIG. 7 illustrates side view of sheet basket assembly encircled rotor assembly, according to an embodiment of the invention.

FIG. 7 illustrates side view of the sheet basket assembly 108 encircled rotor assembly 106, according to an embodiment of the present invention. A polishing chamber 112 is defined as the space between the outer surface of the cam assembly 206 and the sheet basket assembly 108. In an embodiment, an optimum circular gap of 17 mm is kept from cam inner circular surface and 11 mm is kept from protruded circular surface of cam assembly 206 by covering round sheet basket 108 to create the polishing chamber 112. The ratio of 1.545 gap is kept constant throughout the length of the polishing chamber 112 and the rotor is rotated at a speed where the peripheral velocity of cam is in the range of 2.0-4.0 m/sec.

According to an embodiment of the invention the operation of the described pulse polishing machine 100 will be defined herein under. The basic principle of this method is, polishing by grain to grain or pulse to pulse friction. In the operation mixing chamber is used to mix water with pulses. During the process water in the range of 0.2%-3.0% and more preferably as an example water range of 1%-1.5% is mixed with the pulses in mixing chamber. Then the water mixed pulses is directly fed to input of polishing chamber 112 through input means 114 where polishing happens. The mixture is fed to Polishing chamber 112 directly without resting. Due to continuous feeding the chamber 112 gets filled with water mixed pulses. Meanwhile, due to the rotation caused by the electric motor 120 or so called motor 120, drive shaft 200 rotates. Hence, the pulses in the polishing chamber 112 moves forward with the help of helix cam 214 and take circular path inside the chamber. Controlled rod and lever mechanism helps to restrict the pulses outlet and helps to build the pressure inside the polishing chamber 112. As the pressure build-up inside the chamber 112, due to rotation of cam profile compresses the pulses. Hence pulses experience compression and decompression effect. Thus, due to movement the pulses rub each other. This creates pulses to pulses friction and pulses gets polished in one pass as pulses moves from inlet means 114 at one end to outlet means 116 placed diagonally opposite to the inlet means 114. Further, the out flow of pulses is controlled with the help of rod and lever mechanism 118 through outlet means 116.

Pulse polishing machine 100 offers several advantages then the available polishing machines. As the process is neat and clean and there is no interaction of pulses with the leather or material as such and also there is no requirement of use of white powder or glucose like substances on the surface of pulses to increase the smoothness and shininess the process is highly hygienic. The power requirement for the operation of machine is also low and even there is minimal increase in temperature of pulses at output. Other advantages include uniform polishing on flat and curved surfaces, No rounding of pulses edges and reduction in number of broken pulses percentage.

While the preferred embodiment of the invention has been illustrated and described herein, it is to be understood that the invention is not limited to the precise construction herein disclosed, and the right is reserved to all changes and modifications coming within the scope of the invention.

The invention claimed is:

1. A pulse polishing machine, comprising:

a base frame having a vertical support at each longitudinal end;

a rotor assembly placed between the vertical supports through a drive shaft, wherein said rotor assembly comprises a plurality of rotary disks mounted at the ends and a centre of the drive shaft;

a circular cam assembly fixed on the rotary disks, wherein said circular cam assembly further comprises a straight cam set and a helix cam set that are connected, wherein the straight cam set and the helix cam set are made of a plurality of straight cams and a plurality of helical cams, respectively, within which the straight cams and the helix cams have a protruded circular profile in straight line and curved line;

a sheet basket assembly having plurality of circular shaped segments, that encloses the rotor assembly to define a polishing chamber;

a pair of split covers to shield the rotor assembly from either end;

an inlet means at one end and an outlet means at a diagonally opposite end on the sheet basket assembly; and a motor connected to an end of the drive shaft imparting rotary motion to the rotor assembly for polishing pulses.

2. The pulse polishing machine according to claim 1, wherein said drive shaft has keyways on a surface thereof.

3. The pulse polishing machine according to claim 1, wherein said rotary disk at the centre of the drive shaft has a double threaded hole whereas the rotary disks at the ends have a single threaded hole.

4. The pulse polishing machine according to claim 2, wherein the plurality of rotary disks are mounted on the keyways of the drive shaft through a connector bush.

5. The pulse polishing machine according to claim 1, wherein said cam assembly has the helix cam set fitted towards the inlet means and the straight cam set fitted towards the outlet means.

6. The pulse polishing machine according to claim 1, wherein the protruded circular profile on the straight cam and the helix cam is formed by a radius of 3 mm-15 mm with an included angle of 40° to 70°.

7. The pulse polishing machine according to claim 1, wherein said polishing chamber is formed between an outer surface of the cam assembly and the sheet basket assembly.

8. The pulse polishing machine according to claim 1, wherein a gap forming the polishing chamber between the sheet basket assembly and a cam inner radius is larger than a gap between sheet basket assembly and a protruded cam surface, wherein a height of the protruded cam surface is the difference in the gap between the cam inner radius and the protruded cam surface from the sheet basket assembly.

9. The pulse polishing machine according to claim 1, wherein a rotor of the rotor assembly is rotated at a speed where a peripheral velocity of the circular cam assembly is in the range of 2.0-4.0 m/sec.

10. A method of polishing pulses, comprising:

mixing pulses with water in a mixing chamber;

feeding water mixed pulses through an inlet means to a polishing chamber formed between:

an outer surface of a cam assembly fixed on a plurality of rotary disks, wherein said cam assembly further comprises a straight cam set and a helix cam set which are connected, wherein the straight cam set and the helix cam set are made of a plurality of straight cams and a plurality of helical cams respectively, within which the straight cams and the helix cams have a protruded circular profile in straight line and curved line; and a sheet basket assembly;

polishing of pulses by means of pulse to pulse friction in the polishing chamber; and removing polished pulses from the polishing chamber through an outlet means.

11. The method of polishing pulses according to claim 10, wherein said pulses are mixed with 0.2%-3.0% of water.

* * * * *